US006554272B2

(12) United States Patent
Otake et al.

(10) Patent No.: US 6,554,272 B2
(45) Date of Patent: Apr. 29, 2003

(54) SHEET SEPARATION UNIT AND IMAGE FORMING APPARATUS

(75) Inventors: Yoshihisa Otake, Numazu (JP); Hirofumi Hiyoshi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,100

(22) Filed: Aug. 24, 2001

(65) Prior Publication Data

US 2002/0060395 A1 May 23, 2002

(30) Foreign Application Priority Data

Aug. 29, 2000 (JP) ..... 2000-259351

(51) Int. Cl.[7] ..... B65H 3/52
(52) U.S. Cl. ..... 271/121
(58) Field of Search ..... ; 271/104, 121, 271/137, 167, 169; B65H 3/52

(56) References Cited

U.S. PATENT DOCUMENTS 5,951,180 A * 9/1999 Kawaura ..... 400/629

FOREIGN PATENT DOCUMENTS

| | | | | |
|---|---|---|---|---|
| JP | 2-89739 | * | 3/1990 | ..... B65H/3/52 |
| JP | 2-89740 | * | 3/1990 | ..... B65H/3/52 |
| JP | 7-133033 A | | 5/1995 | |
| JP | 9-249321 A | | 9/1997 | |

* cited by examiner

*Primary Examiner*—Donald P. Walsh
*Assistant Examiner*—Kenneth W Bower
(74) *Attorney, Agent, or Firm*—Frishauf, Holtz, Goodman & Chick, P.C.

(57) ABSTRACT

A sheet separation unit comprises a separation/conveyance roller, a separation member to be brought into contact with the roller so as to separate paper sheets drawn by the roller, an elastic member configured to bring the separation member into pressure contact with the roller, and a pair of elastic holding members that apply axial forces to respective opposite end sections of the separation member from the outside. The axial forces press the opposite end sections toward a central portion of the separation member, and the elastic holding members press and hold the separation member in a state in which the separation member can swing to and away from the roller.

12 Claims, 5 Drawing Sheets

SHEET SEPARATION UNIT AND IMAGE FORMING APPARATUS

CROSS-REFERENCE TO RELATED APPLICATIONS

This application is based upon and claims the benefit of priority from the prior Japanese Patent Application No. 2000-259351, filed Aug. 29, 2000, the entire contents of which are incorporated herein by reference.

BACKGROUND OF THE INVENTION

1. Field of the Invention

The present invention relates to a sheet separation unit and an image forming apparatus equipped with the sheet separation unit.

2. Description of the Related Art

Image forming apparatuses such as facsimiles, printers or copy machines incorporate a sheet separation unit configured to separate, for example, stacked recording cut-sheets of paper from one another and to convey them to an image forming mechanism. Many sheet separation units employ a friction separating method.

The sheet separation unit for separating, from one another, sheets of paper stacked in a cassette and conveying them comprises: a unit main body including pivot bearings; a separation/conveyance roller rotatably provided in the unit main body to draw sheets of paper stacked in a cassette and convey them; a separation member located parallel to the separation/conveyance roller, including pivots that project from the each end of the separation member in the direction of their axes and are received in the pivot bearings of the unit main body, the separation member being swingable on the pivots to and away from the separation/conveyance roller, the separation member separating paper sheets drawn by the separation/conveyance roller when it is in contact with the roller; and a separation spring provided in the unit main body and applying a force to the separation member to enable the separation member to be brought into pressure contact with the separation/conveyance roller.

In accordance with the rotation of the separation/conveyance roller corresponding to the direction of sheet conveyance, a few of recording cut-sheets stacked in the cassette are drawn, beginning from the uppermost, to a contact portion of the separation/conveyance roller and the separation member. The thus drawn recording paper sheets are separated from one another by the friction of the rotating separation/conveyance roller and the separation member, and conveyed one by one.

In the sheet separation unit, when each recording paper sheet passes between the separation/conveyance roller and the separation member, the separation member slightly swings on the pivots away from the separation/conveyance roller. After each recording paper sheet has passed, the separation member pressed by the separation spring slightly swings on the pivots to the separation/conveyance roller. As a result, the separation member collides with the outer peripheral surface of the separation/conveyance roller. Thus, in the sheet separation unit, each time recording paper sheets are separated from one another, vibration and collision occur and hence an unpleasant noise occurs.

To enable the sheet separation unit using the friction separating method to separate paper sheets with the occurrence of noise suppressed, several countermeasures have been taken to date. Jpn. Pat. Appln. KOKAI Publications Nos. 7-133033 and 9-249321 disclose sheet separation units devised to suppress such noise. In these units, as well as the separation spring configured to bring the separation member into pressure contact with the separation/conveyance roller, elastic members are employed to apply their elastic forces to the separation member in the radial direction of the pivots. In this structure, vibration of the separation member during the sheet separation and hence occurrence of noise are suppressed by pressing the pivots of the separation member against the respective inner peripheral surfaces of the pivot bearings.

In the above sheet separation units using the friction separating method, however, the friction, which is caused by the elastic members between the pivots and their bearings when the pivots are pressed against the bearings, interrupts the swing operation of the separation member, i.e. interrupts the operation of bringing the separation member into contact with the separation/conveyance roller to separate recording paper sheets.

In other words, when swinging the separation member on the pivots to the separation/conveyance roller, using the force of the separation spring, the friction caused between the pivots and the bearings acts as a resistance that reduces the pressure (separation pressure) applied to the separation member to put it into pressure contact with the outer peripheral surface of the roller. As a result, smooth separation and conveyance of paper sheets cannot be executed.

On the other hand, if the force of the elastic members used to press the pivots of the separation member against the bearings of the unit main body is reduced, it is difficult to effectively suppress the vibration of the separation member and hence the occurrence of noise during the sheet separation.

Therefore, there is a need for a sheet separation unit capable of suppressing the noise of a separation member incorporated therein when it separates paper sheets, while maintaining a smooth separation of the sheets.

BRIEF SUMMARY OF THE INVENTION

A sheet separation unit comprises: a separation/conveyance roller; a separation member to be brought into contact with the roller so as to separate paper sheets drawn by the roller; an elastic member configured to bring the separation member into pressure contact with the roller; and a pair of elastic holding members that apply axial forces to respective opposite end sections of the separation member from the outside. The axial forces pressurize the opposite end section toward a central portion of the separation member, and the elastic holding members pressure hold the separation member in a state in which the separation member can swing to and away from the roller.

BRIEF DESCRIPTION OF THE DRAWING

The accompanying drawings illustrate presently embodiments of the invention, and together with the general description given above and the detailed description of the embodiments given below, serve to explain the principles of the invention.

DETAILED DESCRIPTION OF THE INVENTION

Figure 1:
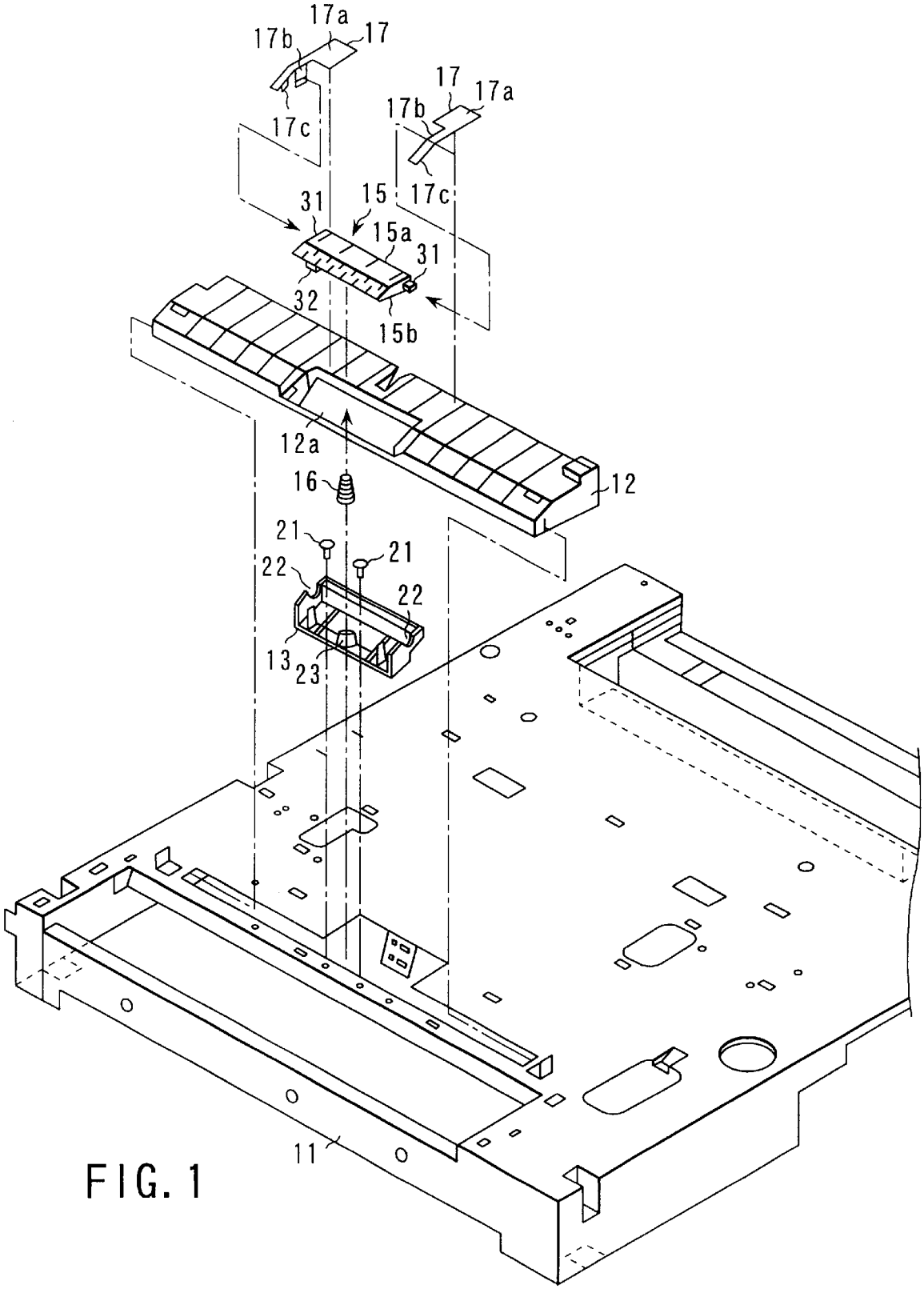
FIG. 1 is an exploded perspective view illustrating a sheet separation unit according to an embodiment of the present invention.
Figure 2:
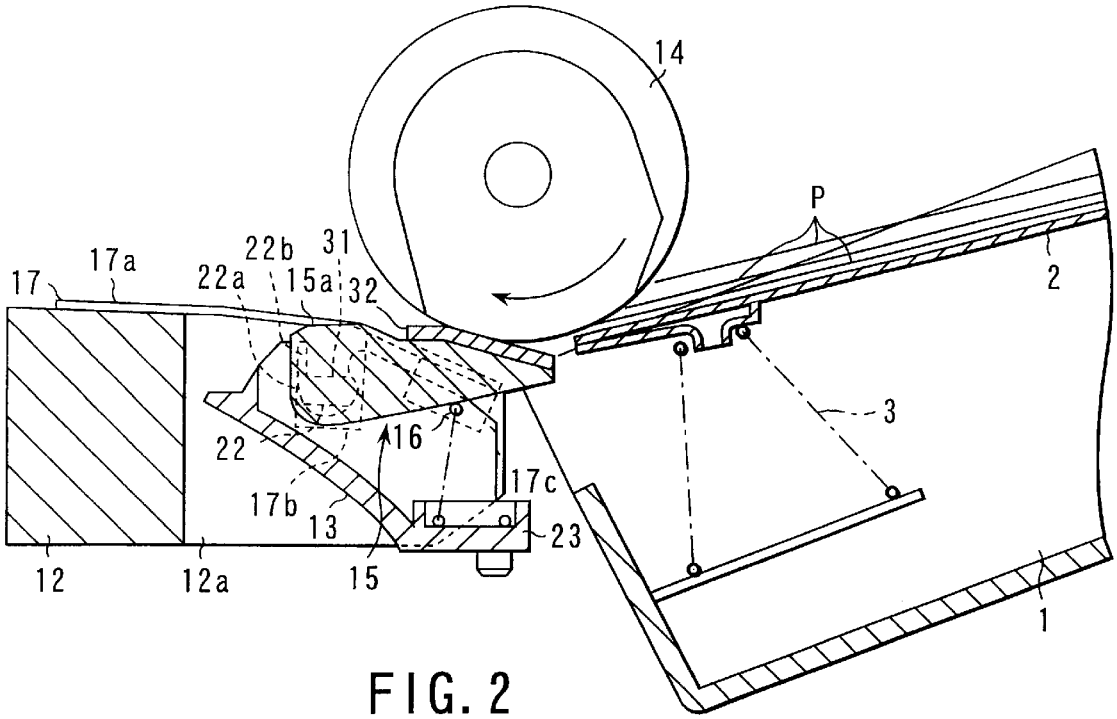
FIG. 2 is a schematic sectional view illustrating a separation member of the sheet separation unit of the embodiment.
Figure 3:
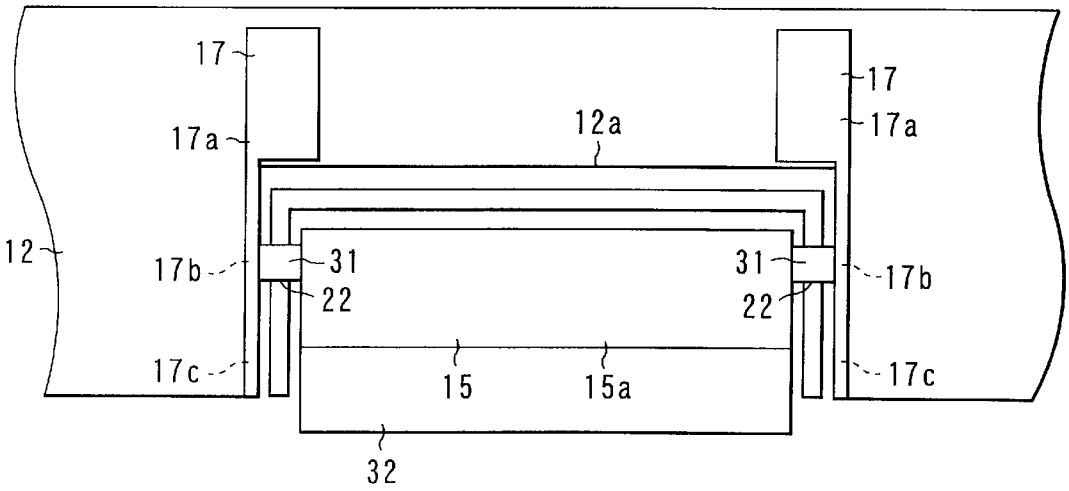
FIG. 3 is a schematic plan view illustrating the separation member of the sheet separation unit of the embodiment.

Referring now to FIGS. 1–3, an embodiment of the present invention will be described.

In this embodiment, a sheet separation unit that sequentially separates, from one another, sheets of recording paper stacked in a cassette, beginning from the uppermost, and conveys them one by one, is applied to an image forming apparatus. Accordingly, the sheet separation unit is located in the image forming apparatus at the downstream side of the cassette with respect to the direction of conveyance.

FIG. 1 is an exploded perspective view illustrating the sheet separation unit of the embodiment, and FIG. 2 is a schematic sectional view illustrating a separation member of the sheet separation unit of the embodiment. FIG. 3 is a schematic plan view illustrating the separation member of the sheet separation unit of the embodiment.

In FIG. 2, reference numeral 1 denotes a flat, box-shaped cassette with an upper opening. A mount plate 2 located in the cassette 1 has its proximal end (its upstream end with respect to the direction of conveyance) supported by the bottom of the cassette 1 so that it can swing vertically. The cassette 1 contains a pantograph spring 3 formed of a helical compression spring. The pantograph spring 3 supports the mount plate 2 from below and always raises it. Stacked recording paper sheets P are placed on the mount plate 2 with the plate 2 once lowered. After the sheets P are stacked on the plate 2, the plate 2 is raised by the force of the pantograph spring 3. The uppermost one of the recording paper sheets P is pressed from above by a press claw (not shown) formed in the cassette 1. As described later in detail, the cassette 1 is arranged such that the leading edge of the mount plate 2 is opposed to a separation/conveyance roller 14.

In FIG. 1, reference numeral 11 denotes a base, reference numeral 12 a guide, and reference numeral 13 a holder. These members configure a sheet separation unit. The base 11 is located at the downstream side of the cassette with respect to the direction of conveyance. The guide 12 is a slender member having a length (width) in a direction perpendicular to the conveyance direction, which corresponds to the length of the recording paper sheet P in the same direction. The guide 12 is fixed on an upstream-side portion of the base 11, and extends in a direction perpendicular to the conveyance direction. A recess 12*a* is formed in a longitudinally central portion of the guide 12, facing an outer peripheral lower portion of the separation/conveyance roller 14. A holder 13 is fixed in the recess 12*a*.

In FIG. 2, reference numeral 14 denotes the aforementioned separation/conveyance roller, reference numeral 15 a separation member, reference numeral 16 a separation spring, and reference numeral 17 an elastic holding member. The separation/conveyance roller 14 is of a length corresponding to the length (width) of the recording paper sheet P in the direction perpendicular to the conveyance direction, and extends above the guide 12 in the direction perpendicular to the conveyance direction. The roller 14 also extends over the downstream end of the cassette 1. The roller 14 has its lengthwise opposite ends rotatably supported by bearings (not shown) formed in the image forming apparatus, and is arranged to be rotated, in a direction indicated by the arrow and corresponding to the sheet conveyance direction, by a rotating mechanism (not shown) employed in the image forming apparatus.

As shown in FIG. 1, the holder 13 is in the shape of a longitudinal box with an upper opening. The holder 13 is located in the recess 12*a* formed in the guide 12 such that it extends in the direction perpendicular to the sheet conveyance direction. Further, the holder 13 is attached to the base 11 by screws 21. Respective pivot bearings 22 are formed in each end wall of the holder 13 located in the direction perpendicular to the sheet conveyance direction. As shown in FIG. 2, each pivot bearing 22 includes a circular hole section 22*a* and an open section 22*b* that connects the upper end of the circular hole section 22*a* to the upper edge of a corresponding end wall. As described later, each pivot bearing 22 is configured such that a corresponding pivot 31 of the separation member 15 can be engaged with and disengaged from the circular hole section 22*a* via the open section 22*b*. A spring holding section 23 is provided at a longitudinally central portion of the holder 13. A separation spring 16 formed of a helical compression spring is held in an upright state by the spring holding section 23. The separation spring 16 is not limited to a helical compression spring, and may be formed of another elastic member made of, for example, a gel material.

The separation member 15 is received in the holder 13 in the direction perpendicular to the sheet conveyance direction, such that it is situated in a position facing a longitudinally central portion of the outer peripheral lower surface of the separation/conveyance roller 14. The separation member 15 includes a pad 32, a longitudinal plate section 15*a* having a length not longer than the length of the holder 13, and end wall sections 15*b* located at the opposite ends of the plate section 15*a*. The respective pivots 31 extend outwardly from the end walls 15*b* in the direction perpendicular to the sheet conveyance direction. The pad 32 is formed of, for example, a rubber sheet and attached to an upper portion of the plate section 15*a*. The separation member 15 is received in the holder 13, and the pivots 31 extending from the opposite end walls 15*b* are vertically swingably supported by the bearings 22 formed in the respective opposite end walls of the holder 13. The pad 32 faces an outer peripheral lower portion of the separation/conveyance roller 14. Accordingly, the separation member 15 is swingable to and away from the outer peripheral lower portion of the separation/conveyance roller 14. When the separation member 15 has swung to the separation/conveyance roller 14, the pad 32 is brought into contact with the outer peripheral lower portion of the separation/conveyance roller 14. On the other hand, when the separation member 15 has swung away from the separation/conveyance roller 14, the pad 32 is separated from the outer peripheral lower portion of the separation/conveyance roller 14.

As shown in FIG. 2, each pivot 31 is of an elliptical section which includes a pair of parallel surfaces obtained by cutting off opposite side portions of a cylindrical member, and arcuate surfaces situated between the pair of parallel surfaces. The inner peripheral surface of the circular hole section 22*a* of each bearing 22 of the holder 13 are kept in contact with the respective arcuate surfaces of a corresponding pivot 31, or positioned outside the arcuate surfaces.

When inserting each pivot 31 into a corresponding bearing 22, each pivot 31 is passed through a corresponding open section 22*b* from the outside of a corresponding bearing 22 so that the elliptical section of each pivot 31 will be situated in the direction of the diameter of the corresponding bearing 22. Thus, each pivot 31 is inserted into the circular hole section 22*a* and rotated therein.

When the separation member 15 is swingably received in the holder 13, the lower surface of the separation member 15 is in contact with the upper end of the separation spring 16 held by the holder 13. As a result, the separation member 15 is always supported and raised by the separation spring 16, and swung about the pivots 31 to the outer peripheral surface of the separation/conveyance roller 14. Accordingly, the pad 32 is brought into pressure contact with the outer peripheral lower portion of the separation/conveyance roller 14.

A pair of elastic holding members 17 are provided at each end portion of the recess 12*a* of the guide 12. The pair of elastic holding members 17 apply respective axial forces to the pivots 31 and hence to a central portion of the separation member 15 from the outside of the pivots, thereby pressure holding the separation member 15 in a state in which it can swing. The elastic holding members 17 are formed of a metal plate spring, and include an attachment section 17*a*, a holding section 17*b* and a reinforcing section 17*c*, which extend in line and are integrated as one body. The reinforcing section 17*c* reinforces the holding section 17*b*. The holding section 17*b* is elastically deformable about the attachment section 17*a* in the direction perpendicular to the sheet conveyance direction, and always applies its elastic force to the guide 12 and to a central portion (longitudinally central portion) of the separation member 15 in the sheet conveyance direction.

The pair of elastic holding members 17 are arranged at each end portion of the recess 12*a* of the guide 12 and outside the each opposite end wall of the holder 13 in the sheet conveyance direction. The attachment section 17*a* is provided on the upper surface of the guide 12 and fixed thereto by, for example, an adhesive. The pivots 31 received by the bearings 22 formed in the each opposite end wall of the holder 13 are situated in the direction perpendicular to the sheet conveyance direction, with their ends outwardly protruded from the respective end walls of the holder 13. The holding sections 17*b* are situated at each end portion of the recess 12*a* of the guide 12 and outside the each opposite end wall of the holder. 13, and are in contact with the respective end faces of the pivots 31 that outwardly project from the each end wall of the member 15. As a result, the holding sections 17*b* apply their elastic forces to the respective pivots 31 from outside thereof in the direction (i.e. the axial direction of the pivots) perpendicular to the sheet conveyance direction, thereby pressing a central portion of the separation member. The elastic forces of the pair of the elastic holding members 17 are set at a value falling within a range that permits the separation member 15 to swing.

Thus, the pair of elastic holding members 17 press and hold the separation member 15 in a state in which the member 15 can swing on the pivots 31. In this case, the holding sections 17*b* apply their forces to the respective pivots 31 and hence toward a central portion of the separation member 15 from the outside of the pivots in the direction (i.e. the axial direction of the pivots) perpendicular to the sheet conveyance direction. This means that the inner peripheral surfaces of the bearings 22 are not used to support the outer peripheral surfaces of the pivots 31 in a state in which the pivots 31 can swing. In other words, the holding sections 17*b* hold the pivots 31 in a floating state, without applying radial forces to the pivots 31.

Further, since the pair of elastic holding members 17 press and hold the pivots 31, provided at the each end of the separation member 15, toward a central portion of the separation member 15 along the axes of the pivots, they can absorb vibration of the separation member 15 by their elasticity.

In the sheet separation unit configured as above, a few of stacked recording paper sheets P are drawn, beginning from the uppermost, to a contact portion of the separation/conveyance roller 14 and the pad 32 of the separation member 15 in accordance with the rotation of the separation/conveyance roller 14 corresponding to the conveyance direction. The thus drawn recording paper sheets P are separated from one another by the friction of the rotating separation/conveyance roller 14 and the pad 32 of the separation member 15, and forwarded one by one.

To separate recording paper sheets P, the separation member 15 swings on the pivots 31 away from the separation/conveyance roller 14 when each recording paper sheet P passes between the separation/conveyance roller 14 and the separation member 15. After each recording paper sheet P passes therebetween, the separation member 15 pressed by the separation spring 16 swings on the pivots 31 to the separation/conveyance roller 14. As a result, the pad 32 collides with the outer peripheral surface of the separation/conveyance roller 14. Vibration that occurs in the separation member 15 because of the swing operation and/or collision is absorbed by the elasticity of the pair of elastic holding members 17 which hold the pivots 31 at the each end of the separation member 15. Thus, the pair of elastic holding members 17 can absorb vibration occurring due to the swing operation or collision of the separation member 15 during the separation of sheets, thereby suppressing the occurrence of noise.

Moreover, the inner peripheral surfaces of the bearings 22 as the pivot bearings of the apparatus main body are not used to support the outer peripheral surfaces of the pivots 31 in a state in which the pivots can swing. Further, radial forces are not applied to the respective bearings 22 of the holder 13, and hence the bearings 22 are kept out of pressure contact with the pivots 31 of the separation member 15. Therefore, the resistance that occurs when swinging the separation member 15 can be significantly reduced. This enables effective use of the force of the separation spring 16, and hence enables the separation and conveyance of paper sheets, with the pad 32 kept in direct contact with the separation roller 14. As a result, the occurrence of noise in the separation member 15 can be suppressed during the separation of recording paper sheets P, while maintaining smooth separation of the paper sheets.

In the above embodiment, a pair of elastic holding members 17 press the separation member 15 toward a central portion thereof by applying their elastic forces to the opposite ends of the member 15, thereby permitting the separation member 15 to swing. However, the pair of the elastic holding members 17 may include a structure that applies radial forces to the respective pivots 31, if it creates only a low resistance when swinging the separation member 15.

Furthermore, in this embodiment, a pair of elastic holding members 17 are attached to the upper surface (the sheet conveying surface) of the guide 12. In other words, after the holder 13 and the guide 12 are attached to the base 11, and then the separation member 15 and the separation spring 16 are attached to the holder 13, thereby assembling a base section of the sheet separation unit, the pair of elastic holding members 17 can be attached to the base section. This means that the sheet separation unit can be assembled easily.

In the embodiment, the holding sections 17*b* of the elastic holding members 17 press and hold the each end face of the pivots 31 of the separation member 15. However, this structure may be modified such that the holding sections 17*b* and the reinforcing sections 17*c* directly press and hold the outer surfaces of the each end wall 15*b* of the separation member 15.

Figure 4:
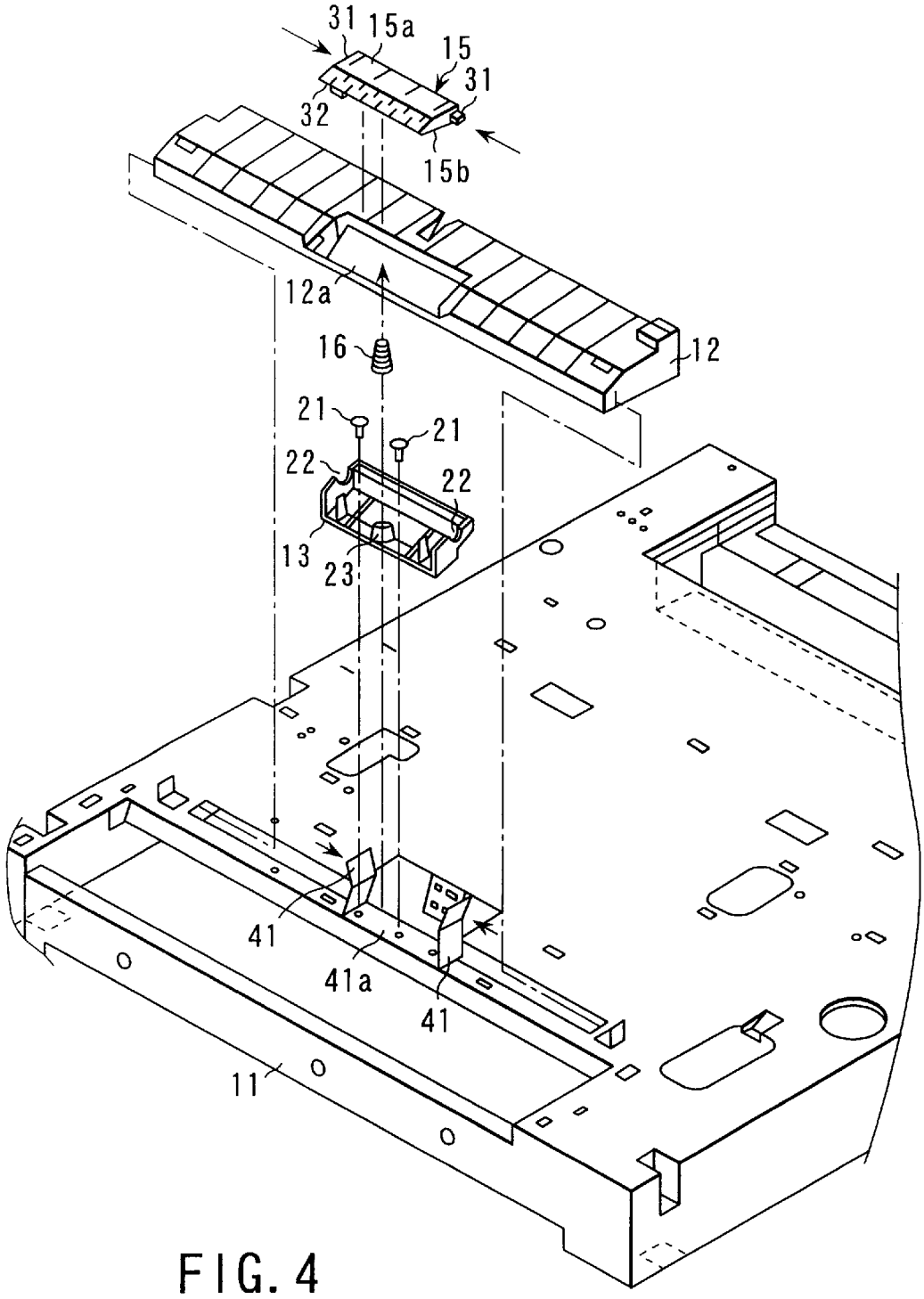
FIG. 4 is an exploded perspective view illustrating a sheet separation unit according to another embodiment of the present invention.

Referring then to FIG. 4, another embodiment will be described. FIG. 4 is similar to FIG. 1, in which like reference numerals denote like elements. In this embodiment, a pair of elastic holding members 41 formed of metal plates are coupled to each other by a coupling section 41*a*. The coupling section 41*a* and the holder 13 are attached to the base 11 by the same screws 21. Since this embodiment employs the elastic holding members 41 coupled as one body by the coupling section 41*a*, it is of a simple structure and can be produced and assembled more easily than in the case of producing elastic holding members individually and assembling them.

Figure 5:
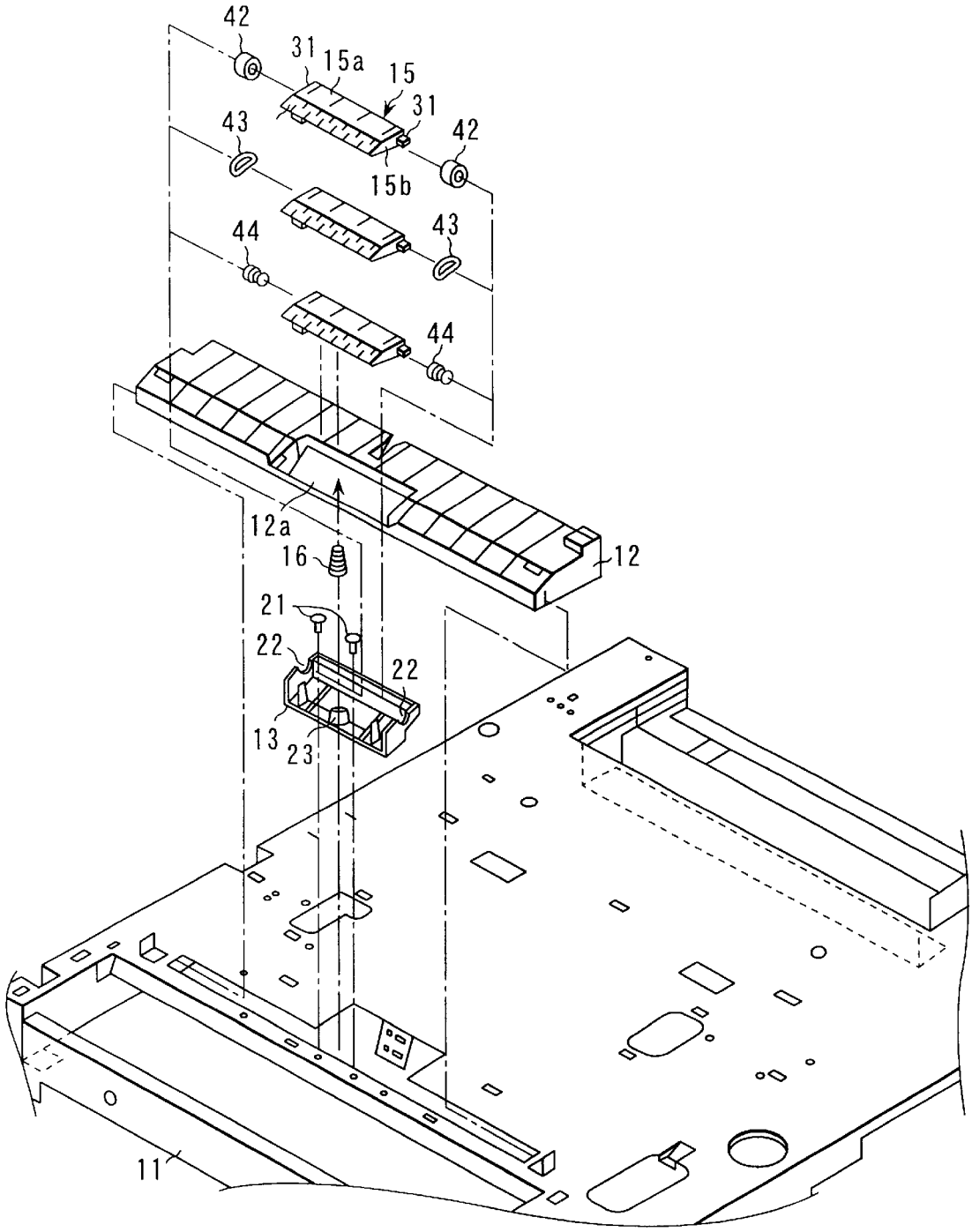
FIG. 5 is an exploded perspective view illustrating a sheet separation unit according to yet another embodiment of the present invention.

Referring to FIG. 5, yet another embodiment will be described. FIG. 5 is similar to FIG. 1, in which like reference numerals denote like elements. FIG. 5 shows three types of elastic holding member.

In FIG. 5, reference numeral 42 denotes a pair of elastic holding members formed cylindrically and made of elastic material, like spongy material. The elastic holding members 42 are fitted on the respective pivots 31 that are received in respective bearings 22 formed in the each end wall of the holder 13. The elastic holding members 42 apply axial forces to the respective end walls 15*b* of the separation member 15 from the outside. These axial forces pressurize the each end wall 15*b* toward a central portion of the separating member 15, thereby press and hold the separation member 15 in a state in which the member 15 can swing.

In FIG. 5, reference numeral 43 denotes a pair of elastic holding members formed of washers that is made of metal or synthetic resin. The elastic holding members 43 are fitted on the respective pivots 31 that are received in respective bearings 22 formed in the each end wall of the holder 13. The elastic holding members 43 apply axial forces to the respective end walls 15*b* of the separation member 15 from the outside. These axial forces pressurize the each end wall 15*b* toward a central portion of the separating member 15, thereby press and hold the separation member 15 in a state in which the member 15 can swing.

In FIG. 5, reference numeral 44 denotes a pair of elastic holding members formed of helical compression springs. The elastic holding members 44 are fitted on the respective pivots 31 that are received in respective bearings 22 formed in the each end wall of the holder 13. The elastic holding members 44 apply axial forces to the respective end walls 15*b* of the separation member 15 from the outside. These axial forces pressurize the each end wall 15*b* toward a central portion of the separating member 15, thereby press and hold the separation member 15 in a state in which the member 15 can swing.

As described above, the pair of elastic holding members are configured to press and hold the separation member 15 in a state in which the member 15 can swing, by applying the axial forces to respective opposite end sections of the separation member 15 from the outside, which pressurize the opposite end sections toward a central portion of the member 15. Various shapes can be employed for the elastic holding members. The opposite end sections of the separation member, which are held by the respective elastic holding members, include both the opposite end walls 15*b* of the separation member 15 and the pivots 31 projecting from the end walls 15*b*.

The present invention is not limited to the above-described embodiments, but may be modified in various ways. Although in the embodiments, the sheet separation unit is applied to an apparatus that separates stacked recording paper sheets from one another and conveying them one by one, it is also applicable to an apparatus that separates and conveys stacked documents, sheets of a recording medium other than paper, sheets of a material other than paper, or post cards, etc.

Figure 6:
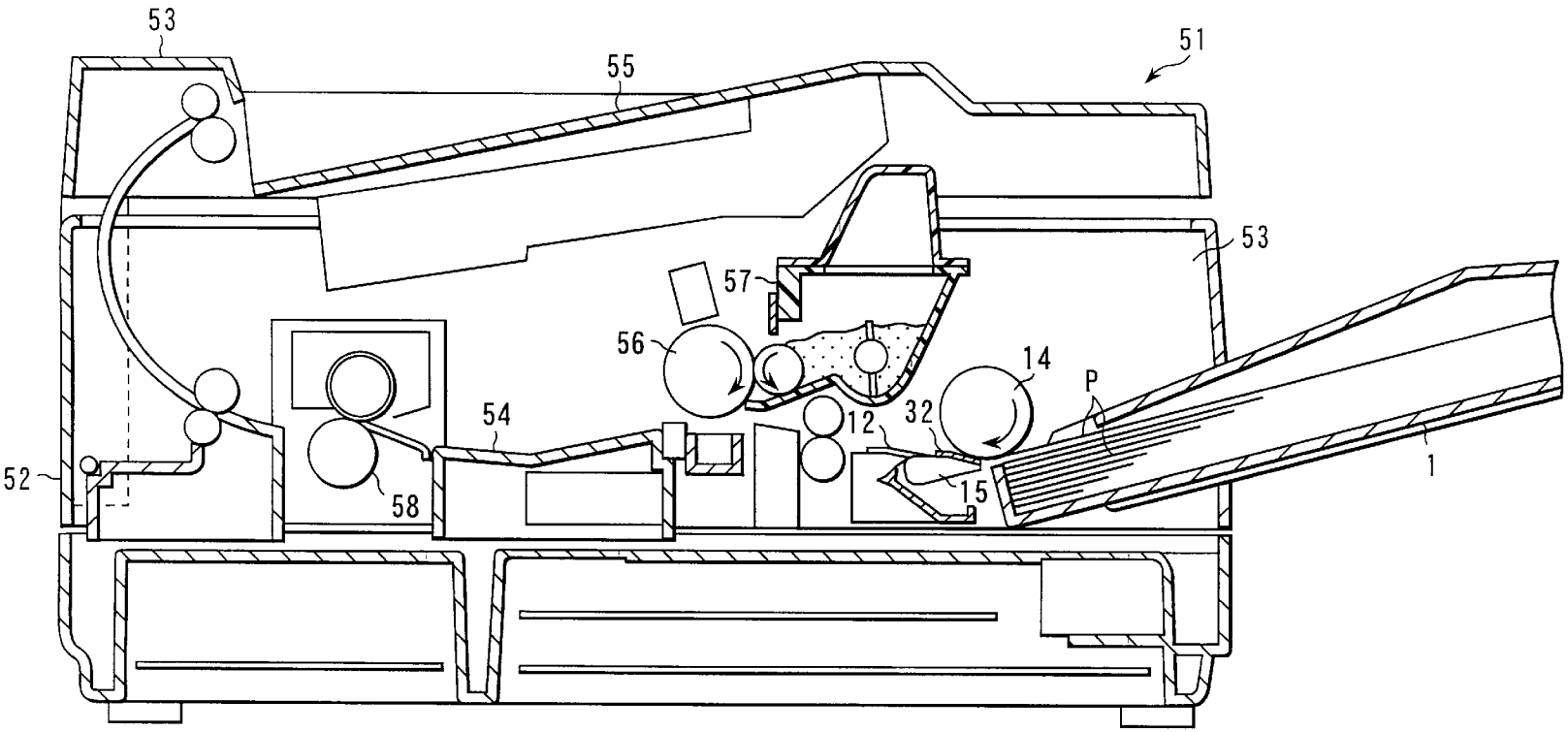
FIG. 6 is a sectional view showing an image forming apparatus according to an embodiment of the present invention.

Referring now to FIG. 6, a description will be given of an embodiment of an image forming apparatus equipped with a sheet separation unit according to an embodiment of the present invention.

As shown in FIG. 6, an image forming apparatus 51 comprises an apparatus main body 52 and a top cover 53. The apparatus main body 52 is provided, at one side thereof, with a cassette 1 that contains paper sheets P as a recording medium in a stacked manner.

A few of the paper sheets P stacked in the cassette 1, which have been forwarded by the separation/conveyance roller 14, are separated from one another when they pass between the roller 14 and the pad 32 of the separation member 15, and are forwarded to a conveyance path 54. The apparatus main body 52 includes a unit containing chamber 53. The conveyance path 54 is formed in the unit containing chamber 53. The conveyance path 54 is configured to convey the paper sheets P stacked in the cassette 1 to a stacker table 55.

An image formed by exposure on a photosensitive drum 56 is developed by a developing unit 57 into a toner image. The toner image is transferred from the photosensitive drum 56 to each paper sheet P. Each paper sheet P, a toner image on which is fixed by a fixing unit 58, is discharged to the stacker table 55 via the conveyance path 54.

Additional advantages and modifications will readily occur to those skilled in the art. Therefore, the invention in its broader aspects is not limited to the specific details and representative embodiments shown and described herein. Accordingly, various modifications may be made without departing from the scope of the general inventive concept as defined by the appended claims and their equivalents.

What is claimed is:

1. A sheet separation unit comprising:

pivot bearings;

a separation/conveyance roller configured to draw and convey a paper sheet;

a separation member located parallel to the separation/conveyance roller, including pivots that axially project from each end of the separation member and are received in the respective pivot bearings, the separation member being swingable on the pivots to and away from the separation/conveyance roller, the separation member separating paper sheets from one another drawn by the separation/conveyance roller when it is in contact with the separation/conveyance roller;

an elastic member that applies a force to the separation member to bring the separation member into pressure contact with the separation/conveyance roller; and a pair of elastic holding members that apply axial forces to respective opposite end sections of the separation member from outside, the axial forces pressurizing the opposite end sections toward a central portion of the separation member, the elastic holding members pressing and holding the separation member in a state in which the separation member can swing to and away from the separation/conveyance roller.

2. The sheet separation unit according to claim 1, wherein the pair of elastic holding members each include an attachment section and a holding section, the holding section being elastically deformable about the attachment section in a direction perpendicular to sheet conveyance direction.

3. The sheet separation unit according to claim 2, wherein the holding section axially presses and holds, from outside, a corresponding one of the pivots of the separation member.

4. The sheet separation unit according to claim 2, wherein the holding section axially presses and holds, from outside, a corresponding one of outer surfaces of end walls of the separation member.

5. The sheet separation unit according to claim 2, wherein the pair of elastic holding members are formed of a metal plate spring.

6. The sheet separation unit according to claim 2, wherein the pair of elastic holding members are integrated as one body.

7. The sheet separation unit according to claim 1, wherein the pair of elastic holding members are fitted on the respective pivots of the separation member and axially press and hold outer surfaces of end walls of the separation member.

8. The sheet separation unit according to claim 7, wherein the pair of elastic holding members are formed of a spongy material.

9. The sheet separation unit according to claim 7, wherein the pair of elastic holding members are formed of a washer.

10. The sheet separation unit according to claim 7, wherein the pair of elastic holding members are formed of a helical compression spring.

11. A sheet separation unit comprising:

pivot bearings;

a separation/conveyance roller configured to draw and convey a paper sheet;

a separation member located parallel to the separation/conveyance roller, including pivots that axially project from each end of the separation member and are received in the respective pivot bearings, the separation member being swingable on the pivots to and away from the separation/conveyance roller, the separation member separating paper sheets from one another drawn by the separation/conveyance roller when it is in contact with the separation/conveyance roller;

an elastic member that applies a force to the separation member to bring the separation member into pressure contact with the separation/conveyance roller; and means for applying axial forces to respective opposite end sections of the separation member from outside, the axial force pressurizing the opposite end sections toward a central portion of the separation member, the means pressing and holding the separation member in a state in which the separation member can swing to and away from the separation/conveyance roller.

12. An image forming apparatus comprising:

pivot bearings;

a separation/conveyance roller configured to draw and convey a paper sheet;

a separation member located parallel to the separation/conveyance roller, including pivots that axially project from each end of the separation member and are received in the respective pivot bearings, the separation member being swingable on the pivots to and away from the separation/conveyance roller, the separation member separating paper sheets from one another drawn by the separation/conveyance roller when it is in contact with the separation/conveyance roller;

an elastic member that applies a force to the separation member to bring the separation member into pressure contact with the separation/conveyance roller;

a pair of elastic holding members that apply axial forces to respective opposite end sections of the separation member from outside, the axial forces pressurizing the opposite end sections toward a central portion of the separation member, the elastic holding members pressing and holding the separation member in a state in which the separation member can swing to and away from the separation/conveyance roller; and a printing section configured to form an image on each paper sheet separated by the separation/conveyance roller and the separation member.

* * * * *